United States Patent [19]

Gouge

[11] 4,432,113

[45] Feb. 21, 1984

[54] BACK WASHER

[76] Inventor: Howard W. Gouge, Rte. 1, Box 256, Unicoi, Tenn. 37692

[21] Appl. No.: 356,112

[22] Filed: Mar. 8, 1982

[51] Int. Cl.[3] ..... A61H 33/00

[52] U.S. Cl. ..... 15/97 R; 15/21 C; 128/56

[58] Field of Search ..... 15/21 C, 21 D, 97 R, 15/23, 28; 128/46, 49, 52, 56, 62 R

[56] References Cited

U.S. PATENT DOCUMENTS

| | | | |
|---|---|---|---|
| 1,609,796 | 12/1926 | Cheney | 128/56 |
| 2,210,094 | 8/1940 | Mueller | 15/23 X |
| 2,730,737 | 1/1956 | Herman | 15/97 R X |
| 2,827,794 | 3/1959 | Weimersheimer | 15/97 R X |
| 3,102,294 | 9/1963 | Miller et al. | 15/97 R |
| 3,343,192 | 9/1967 | Goldstein et al. | 15/23 |

*Primary Examiner*—Edward L. Roberts

*Attorney, Agent, or Firm*—Pitts, Ruderman & Kesterson

[57] ABSTRACT

An apparatus for providing automatic back washing for a user is disclosed. The back washer of this invention includes a housing (14) which contains an electrical drive source such as a motor (48), gearing means (52) and a switching means (26). According to a preferred embodiment, insulated extension member (36) is provided for activating the switch (46) while the back washer is in operation. The gearing means (52) drives a detachable mounting member (56) to which there is attached padding and a cover (40) and (62), respectively. In the preferred embodiment, power shaft (54) is driven by gearing means (52) and includes ridges and grooves to provide a spline which in turn cooperates with a sleeve (82). According to the preferred embodiment the apparatus is portable and sets on a bathroom counter.

5 Claims, 4 Drawing Figures

BACK WASHER

DESCRIPTION

1. Technical Field

This invention relates generally to methods and apparatus for following an individual to wash their back, and more particularly to apparatus electrically driven to provide for the automatic back washing of an individual who may have difficulty because of injury, illness or age to properly reach and thoroughly wash his or her back. The apparatus according to a preferred embodiment is portable and designed to be placed on a cabinet in a bathroom. A readily detachable cloth (such as terry-cloth) is included on a moving pad which may either move in a rotating or oscillating manner.

2. Background Art

A review of the prior art related to this field discloses that there are presently in existence various types of devices designed to facilitate the washing of an individual's back while taking a bath or shower. However, most of these other types of back washing devices either rely upon manual movement of the washing brush or pad, or otherwise require extensive and complex built-in installations. Some of the built-in type back washers use the power of the water pressure itself for driving a back washer, whereas some of the others may in fact use electrical motors. However, none of these devices meet all of the requirements of being a readily available, easily installed device which is both safe and suitable for an injured, arthritic or aged person to use, since the apparatus of this invention does not require undue bodily exercise or contortions to drive the washing means. For example, U.S. Pat. No. 3,078,484 issued to Rawley L. Briggs on Feb. 26, 1963 and U.S. Pat. No. 3,085,269 issued to Robert Greer on Apr. 16, 1963 disclose typical manually driven back washers of the prior art. In each of these patents, the brush is driven in an oscillating manner by means of reciprocating motion imparted to the brush by a pair of cords which are alternately pulled, and which extend over the shoulder of the user or perhaps down to the user's side. In either case, considerable back and forth motion or up and down motion is required to impart motion to the washing brush. It will be appreciated that for an arthritic, aged person, or otherwise injured person, such vigorous exercising motion may not be possible. Also, as shown by these two references, these devices require at least a semi-permanent installation by either bolting or otherwise permanently mounting to a wall. Another U.S. Pat. having No. 4,151,623 and issued to R. J. Steere on May 1, 1979, discloses a back washing device which operates from the flowing water which drives a turbine and which turbine in turn drives the rotating brush. Again, although this device does not require the bathing person to engage in physical exercise to drive the back washer, it does require extensive installation and may be used only within the tub or shower as the flow of water used as the driving source would otherwise run onto the floor. Still another patent have U.S. Pat. No. 4,040,132 issued to George Braun on Aug. 9, 1977, discloses a motor driven device which includes a set of rollers such as three which are permanently installed within a shower. The device is powered by an electrical motor, and is turned on before the individual steps into the shower. The three rotating rollers are located such that the person may back up against these rollers for cleaning his or her back. Although this device is automatic, it still must be permanently installed and simply does not offer the great simplicity of operation as is necessary if the device is to be used by an aged or arthritic person as well as a healthy and active individual.

Therefore, it is an object of the present invention to provide simple and inexpensive methods and apparatus to allow automatic washing of an individual's back.

It is still another object of this invention to provide methods and apparatus to allow for the automatic washing of individual's back with apparatus which does not require complex and expensive installation.

It is yet another object of the present invention to provide simple and inexpensive apparatus which may be readily controlled by a person having restricted movement and reduced strength.

It is still another object of the present invention to provide apparatus which allows ready and easy cleaning of the washing pads, and which does not require installation over or within a shower or tub.

DISCLOSURE OF THE INVENTION

Other objects and advantages will in part be obvious and will in part appear hereinafter, and will be accomplished by the present invention which defines apparatus and methods for providing automatic back washing for an individual. The apparatus comprises an electrical driving means for receiving electrical power from an external power source and for providing rotational power to a drive shaft such as, for example, an electrical motor. Also included is a gearing means which has an input connected to the drive shaft of the power source and an output power shaft extending to a further end. The gearing means receives rotational power from the electrical drive means such as a rotating motor, and provides a selective motion to the power shaft output of the gearing means. The selected motion will typically be rotational or oscillating motion. Also included is a switch or switching means connected between the external power source and the electrical driving means or motor for turning the electrical motor on and off. A housing or container supports, contains and protects the drive means, the gearing means and the switching means such that water or liquid may not interfere with the operation or expose the user to dangerous electrical shock. Further, the housing includes an aperture such that the power shaft may extend from the gearing means contained within the housing through the aperture and exterior to the housing. A mounting member which is readily attached to and detached from the externally extending power shaft rotates or oscillates in response to similar movement of the power shaft. The padding, the mounting member and a cover are then removed and soap and water is added. The unit is then replaced for use. The user then simply turns the unit on and places his back up against the moving padding and cover for achieving the back wash.

According to a preferred embodiment, the apparatus further includes an extending insulated member for activating the switch such that the user may back up against the padding and cover and then simply reach up at about eye level, and turn the unit on or off. Also, although the unit could be installed permanently, according to the preferred embodiment, the apparatus is portable such that it may be readily set on a bathroom counter for ready access and use.

BRIEF DESCRIPTION OF THE DRAWINGS

The above mentioned features of the present invention will be more clearly understood from the consideration of the following description in connection with the accompanying drawings in which.

BEST MODE FOR CARRYING OUT THE INVENTION

Figure 1:
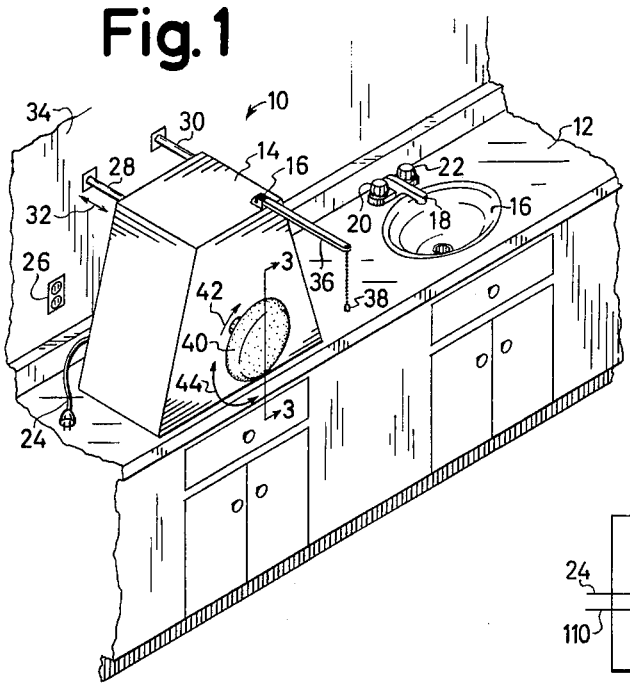
FIG. 1 is a perspective view of the back washer of this invention in place on a bathroom counter and ready for use.

Referring now to FIG. 1, there is shown generally at 10 a preferred embodiment of the present invention which is portable and suitable for placing on the cabinet 12 in a bathroom at a distance of between about 2½ feet and 4 feet above the floor. As shown, the case 14 of the apparatus 10 is placed on the counter 12 which would typically also include a wash basin 16 with a faucet 18 and controls 20 and 22. The housing 14 itself typically contains an electrical power cord 24 which may be connected to any suitable external or household power source such as a power socket 26. In the embodiment shown in FIG. 1, housing 14 is shown to be a four sided truncated pyramid shape. However, it will be appreciated that such a shape is not necessary and any suitable shape which may conserve space, or which may fit in with the decor of the bathroom may be used. As shown the apparatus 10 further includes two spacers 28 and 30 the length of which are adjustable in the directions indicated by arrow 32 such that the apparatus 10 may be positioned at a selected distance from the wall 34. Also included in the preferred embodiment, is an insulating extension member 36 which as will be discussed hereinafter activates an electrical switch internal to housing 14. In a typical example, the extension member 36 may have attached thereto a cord 38 at the end such that the user may simply reach up over one's shoulder or about at eye level to activate or turn the machine on and off. There is further included a combination mounting member, pad and cover unit 40 which has selective motion such as, for example, rotational motion as indicated by arrow 42. Alternatively, oscillating motion as indicated by arrow 44 may be provided. Thus, in operation, and as will be discussed in detail hereinafter, the user may simply remove the pad unit 40 from the apparatus 10, add moisture such as water and soap and then replace the pad unit on the apparatus. Then to use the apparatus, the user simply backs up against the pad, reaches up and activates the internal switch by means of extension member 36 and cord 38 which results in the rotational or oscillating motion to wash the individual's back. Upon completion, the switch 36 or 38 is again activated and the unit is turned off.

Although the above discussion with respect to FIG. 1 of the preferred embodiment teaches a portable unit which sets on a bathroom counter, it will be appreciated that the unit could also be built-in.

Figure 2:
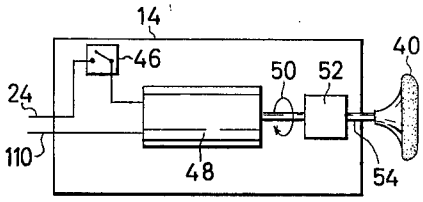
FIG. 2 is a partially block and partially schematic diagram showing the features of the present invention.

Referring now to FIG. 2, there is shown a partial block and schematic diagram of the apparatus described with respect to FIG. 1. It will be appreciated that those elements or portions of the device shown in FIG. 2 which are the same as that of FIG. 1 will carry the same reference numbers. In addition, it will be appreciated that those elements common to the remaining figures of this disclosure which are also common to the previously discussed elements will also carry similar reference numbers. As shown in FIG. 2, housing 14 is indicated by the border outline. Input power is provided by plug or line 24 which goes through a switch 46. The power from line 24 is therefore applied to an electrical drive source such as a motor 48 which provides a rotating output on drive shaft 50. Drive shaft 50 in turn is connected to the input of a gearing means 52 which in turn provides a power output on shaft 54. The gearing means 52 can be any suitable gearing means which will typically provide slow rotating power to power output shaft 54 by reduction gearing to slow down the rotational speed of the power source 48. In other embodiments, the gearing means 52 may also translate the rotational power of drive shaft 50 into an oscillating motion output at power shaft 54. Although it will be appreciated that any suitable gearing means which can achieve the desired results may be used, it has been found that the speed and rotation typically used by the agitator of a home washing machine provides exceptionally fine results. Thus, it is contemplated that the motor and drive train of a washing machine may be particularly suitable for use with the present invention. Attached to power output shaft 54 as was discussed hereinabove is the combination unit 40 which includes a mounting member, padding, and an outside cover which will be discussed in detail hereinafter.

Figure 3:
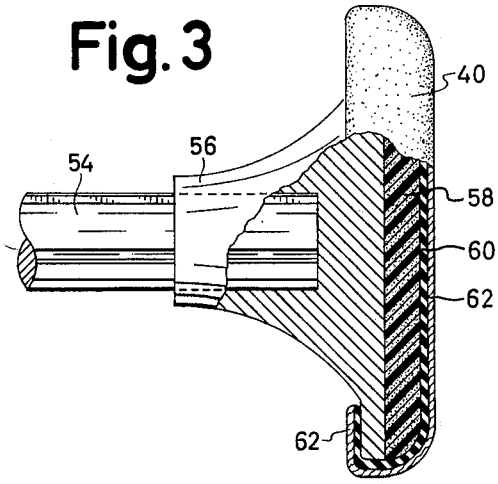
FIG. 3 shows a partially cross-sectional view of a preferred embodiment of the mounting member, and the padding and cover of the present invention.

Referring now to FIG. 3, there is shown a partially cross-section view of the output power shaft 54, and attachable and detachable mounting member 56 to which there is also attached pad combination 40. As shown, in a preferred embodiment the padding unit 40 includes a resilient or foam rubber backing 58 permanently attached to mounting member 56. Completely covering and enclosing resilient foam rubber 58 is a water impervious cover 60 which may be made of any suitable water impervious material such as vinyl, rubber or the like. Finally, as shown, there is a readily detachable outside cover 62 which is preferably made of a terrycloth material. It will be appreciated that although any suitable type of padding and cover will operate with the present invention, the resilient foam rubber pad, the water impervious vinyl cover, and the detachable terrycloth cover has been found to be the most desirable for use.

Figure 4:
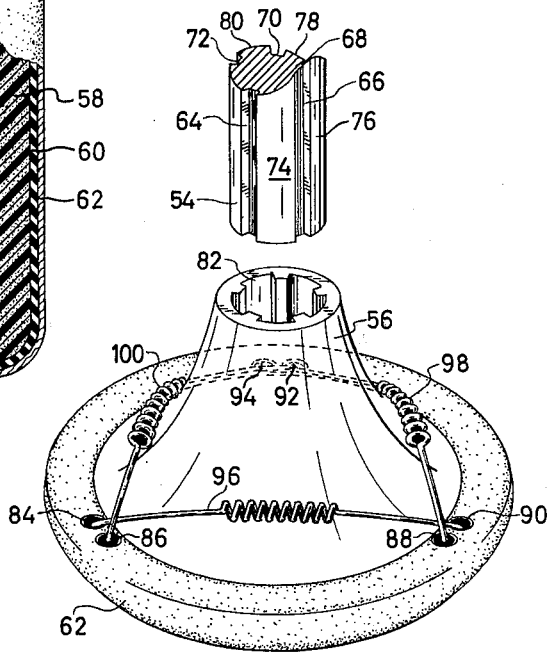
FIG. 4 illustrates the spline and matching sleeve technique for readily attaching and detaching the mounting member from the power shaft of the present invention and also illustrates the preferred method of attaching the outside replaceable cover to the padding and mounting member.

Now, referring to FIG. 4 there is shown a preferable embodiment by which mounting member 56 may be detachably joined or connected with power shaft 54. As shown in FIG. 4, power shaft 54 includes parallel grooves such as 64, 66, 68, 70 and 72, between which there are ridges 74, 76, 78 and 80. In a similar manner, the mounting member 56 forms a receiving sleeve 82 which includes apposite ridges and grooves such that the receiving sleeve 82 readily slides on and off of shaft 54. Yet, when attached, because of the alternating ridges and grooves, it will be appreciated that any rotating oscillating motion of power shaft 54 will transmit such rotational and oscillating motion to the pad unit 40.

Further, FIG. 4 clearly shows the preferred method of mounting the terrycloth outside cover 62 to the pad unit 40. As shown, the terrycloth unit 62 includes as the preferred embodiment, holes or apertures such as 84 through 94. Between selected ones of these holes, there are stretched springs 96, 98 and 100. The springs are easily hooked and unhooked from the apertures or eyes such that the pad may be readily exchanged.

Thus, although the present invention has been described with respect to specific methods and apparatus for providing an automatic and portable back washer, it is not intended that such specific references be considered limitations upon the scope of the invention except insofar as is set forth in the following claims.

I claim:

1. Apparatus for providing automatic back washing for a user comprising:

an external electrical power source;

an electrical driving means for receiving electrical power from said external electrical power source and for providing rotational power to a drive shaft;

gearing means having an input connected to said power source drive shaft and an output power shaft extending from a first end to a further end, said gearing means receiving the output rotational power of said electrical drive means and providing selected motion to said output power shaft;

switching means connected between said external electrical power source and said electrical driving means for selectively turning said electrical driving means on and off;

a housing having an upper portion, lower portion and a front face for supporting, containing therein, and protecting said electrical driving means, said gearing means and said switching means, said housing further defining an aperture in said front face to allow said further end of said power shaft of said gearing means to extend through said aperture and external to said housing;

a mounting member detachably connected to said output power shaft such that motion of said power shaft causes a corresponding motion of said mounting member;

padding attached to said mounting member;

an outside cover readily attachable and detachable to and from said padding to allow easy exchange, said automatic back washing apparatus operating to provide movement to said padding and cover to allow said user to place the back against said padding and cover, and thereby wash their back; and wherein said switching means includes an insulated actuating member external to said housing extending from said front face at said upper portion of said housing to a position readily accessible by said user to allow ready operation of said switching means by said user while said apparatus is actively washing said user's back.

2. The apparatus of claims 1 wherein said mounting member, padding and cover attached thereto may be readily detached as a unit from said power shaft such that said unit may have water and a cleaning solution added thereto and then replaced on said power shaft.

3. The apparatus of claims 1 wherein said padding includes a resilient layer permanently attached to said mounting member and a water impervious protective cover over said resilient layer to prevent said resilient layer from absorbing liquid.

4. The apparatus of claim 1 wherein said power output shaft includes grooves and ridges extending lengthwise and parallel along said power output shaft, and said mounting member includes a receiving sleeve having opposite grooves and ridges for meshing with said grooves and ridges of said power output shaft such that any rotational or oscillating motion of said power output shaft is transmitted to said mounting member.

5. The apparatus of claims 1 wherein said housing is suitable for locating said mounting member, padding and cover between about two and one-half feet and four feet above the floor when placed on a bathroom counter.

* * * * *